US005946522A

United States Patent [19]

Inami

[11] Patent Number: 5,946,522

[45] **Date of Patent: *Aug. 31, 1999**

[54] IMAGE FORMING APPARATUS AND CARTRIDGE MOUNTABLE ON THE SAME

[75] Inventor: Satoru Inami, Kashiwa, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/775,135

[22] Filed: Dec. 31, 1996

[30] Foreign Application Priority Data

Jan. 9, 1996 [JP] Japan ..... 8-018085

[51] Int. Cl.[6] ..... G03G 15/08

[52] U.S. Cl. ..... 399/27; 399/119

[58] Field of Search ..... 399/30, 29, 27, 399/119; 118/693, 688

[56] References Cited

U.S. PATENT DOCUMENTS 5,229,821 7/1993 Fujii .

5,500,714 3/1996 Yashiro et al. .

*Primary Examiner*—R. L. Moses

*Attorney, Agent, or Firm*—Fitzpatrick, Cella, Harper & Scinto

[57] ABSTRACT

This specification discloses an image forming apparatus having an image bearing member, developing means for causing a developer to adhere to the image bearing member to thereby develop a latent image, the developing means having a developer carrying member carrying the developer thereon, residual amount detecting means for detecting the amount of developer residual in the developing means, the residual amount detecting means measuring the electrostatic capacity between an electrode disposed near the developer carrying member and the developer carrying member, comparing means for comparing the electrostatic capacity measured by the residual amount detecting means with a reference value, and judging whether the amount of residual developer is greater or smaller than a predetermined value, memory means for memorizing information for correcting the reference value, and correcting means for correcting the reference value in conformity with the correcting information.

12 Claims, 12 Drawing Sheets

IMAGE FORMING APPARATUS AND CARTRIDGE MOUNTABLE ON THE SAME

BACKGROUND OF THE INVENTION

1. Field of the Invention

This invention relates to an image forming apparatus such as an electrophotographic apparatus or an electrostatic recording apparatus and a cartridge mountable on this apparatus, and particularly to an image forming apparatus having a mechanism for detecting the amount of developer residual in a developing device, and a cartridge.

2. Related Background Art

In an image forming apparatus using the electrophotographic image forming process, there has heretofore been adopted a process cartridge system in which an electrophotographic photosensitive member and process means acting on the electrophotographic photosensitive member are integrally made into a cartridge which is removably mountable on the main body of the image forming apparatus. According to this process cartridge system, the maintenance of the apparatus can be done by a user himself without a serviceman being resorted to and therefore, operability could be markedly improved. So, this process cartridge system is widely used in image forming apparatuses.

In an image forming apparatus of such a cartridge type, the user himself interchanges the cartridge and therefore, means for informing the user when the toner has been consumed or when the life of a photosensitive drum which is an electrophotographic photosensitive member has completed its span.

So, there has been proposed a method of integrating and memorizing the amount of use of the cartridge by utilizing non-volatile memory means such as EEPROM as means for detecting the lives of parts and the amount of consumed toner. For example, Japanese Patent Laid-Open Application No. 61-185761 describes an image forming apparatus provided with means for adding and memorizing the information of the exposure time when a photosensitive drum in a process cartridge is exposed to a laser beam or a light emitting diode, i.e., information corresponding to the amount of remaining toner.

Also, such a process cartridge is frequently mounted and dismounted with respect to an apparatus body and therefore, it has also been proposed to contain memory means in the cartridge itself, and enhance the detection accuracy when for example, a plurality of cartridges are used for an apparatus body. For example, Japanese Patent Laid-Open Application No. 63-212956 proposes an electrophotographic recording apparatus in which a memory is provided within a cartridge and means for effecting the reading-out/writing-in of the memory is provided in the apparatus body and the calculation of information regarding the life of the cartridge is effected on the basis of the content read out from the memory and the electrophotographic operation and the information is written into the memory.

Also, Japanese Patent Laid-Open Application No. 3-230172 proposes an image forming apparatus in which a non-volatile memory medium provided in an interchangeable unit is caused to memorize the information of the characteristic of the unit and the amount by which the unit has been used.

Also, as another method of detecting the time of interchange of a cartridge, there has been proposed a method of directly detecting the amount of toner remaining in a cartridge, and informing the user when the amount of remaining toner has become a predetermined value or less, to thereby call upon the user to interchange the cartridge. For example, Japanese Patent Laid-Open Application No. 62-62352 describes a method of disposing an antenna for detecting the amount of residual toner near a developing roller which is a developer carrying member, measuring an electric current induced in the antenna when an AC voltage is applied to the developing roller, and detecting the amount of residual toner by utilizing the fact that it changes in conformity with the amount of toner between the developing roller and the antenna.

However, the method of detecting the amount of residual toner by the change in the electrostatic capacity between the sleeve and the antenna described in Japanese Patent Laid-Open Application No. 62-62352 has suffered from the following inconveniences. Since the above-described means is one for detecting a delicate change in the electrostatic capacity between the sleeve and the antenna, it is desirable that the distance between the sleeve and the antenna be free of any individual difference and be constant. However, a dimensional tolerance always occurs in manufacture and therefore, the distance between the sleeve and the antenna cannot always be said to be as per the design value. Also, the antenna bar used is often as small as possible in its diameter in order not to hamper the movement of a toner in a developer container 6 and therefore, when mounted on an image forming apparatus, the antenna bar becomes liable to flex in its lengthwise direction. Thus, the distance between the sleeve and the antenna becomes long in some portion and short in some portion and disorder occurs to the delicate change in the electrostatic capacity.

SUMMARY OF THE INVENTION

The present invention has been made in view of the above-noted problems and an object thereof is to provide an image forming apparatus which can accurately detect the amount of residual toner and a cartridge mountable in this apparatus.

Another object of the present invention is to provide an image forming apparatus having an image bearing member, developing means for causing a developer to adhere to the image bearing member to thereby develop a latent image, the developing means having a developer carrying member carrying the developer thereon, residual amount detecting means for detecting the amount of developer residual in the developing means, the residual amount detecting means measuring the electrostatic capacity between an electrode disposed near the developer carrying member and the developer carrying member, comparing means for comparing the electrostatic capacity measured by the residual amount detecting means with a reference value, and judging whether the amount of residual developer is greater or smaller than a predetermined value, memory means for memorizing information for correcting the reference value, and correcting means for correcting the reference value in conformity with the correcting information.

Still another object of the present invention is to provide a cartridge having developing means for supplying a developer to an image bearing member, the developing means having a developer carrying member and an electrode for detecting the amount of developer residual in the developing means, and memory means for memorizing information for correcting a reference electrostatic capacity for judging whether the amount of residual developer is greater or smaller than a predetermined value.

Further objects of the present invention will become apparent from the following detailed description taken in conjunction with the accompanying drawings.

DESCRIPTION OF THE PREFERRED EMBODIMENTS

An electrophotographic image forming apparatus, a process cartridge and a developing device according to the present invention will hereinafter be described in greater detail with reference to the drawings.

Figure 1:
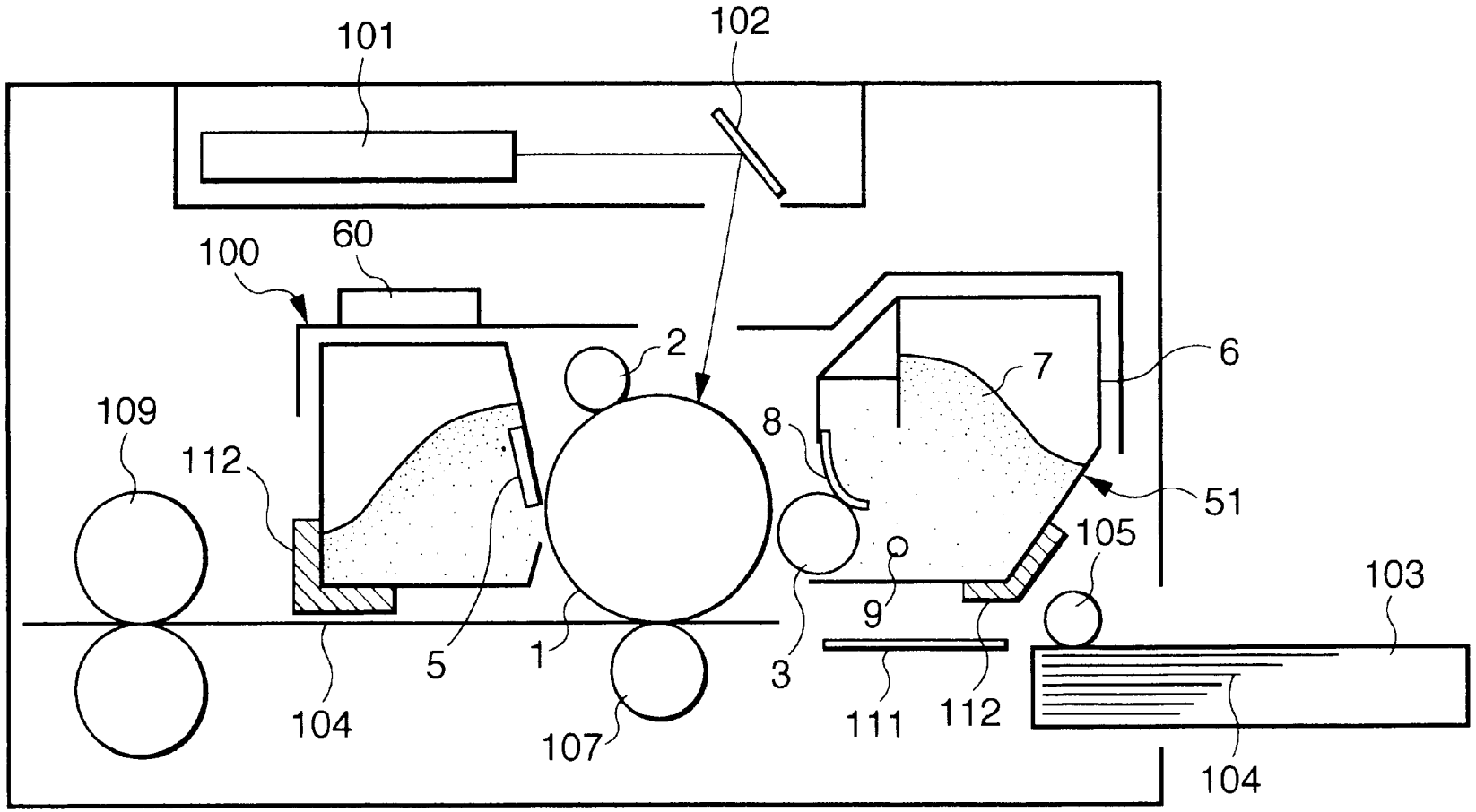
FIG. 1 shows the general construction of an example of an electrophotographic image forming apparatus into which the present invention is embodied.

Reference is first had to FIG. 1 to describe a first embodiment of the electrophotographic image forming apparatus in which is mountable a process cartridge constructed in accordance with the present invention.

As shown in FIG. 1, the image forming apparatus is such that a laser beam modulated in conformity with an image signal is outputted from a scanner unit 101 including a laser and a polygon mirror correcting system lens. This laser beam is reflected by a turn-back mirror 102 and is applied onto a photosensitive drum which is an electrophotographic photosensitive member. The photosensitive drum 1 is uniformly precharged by a charging roller 2 which is charging means, and an electrostatic latent image is formed on the surface thereof in conformity with the application of the laser beam.

On the other hand, a developer (toner) 7 stored in a developer container 6 which is the developer containing portion of a developing device 51 is conveyed while charging the peripheral surface of a developing roller 3, and a toner layer capable of developing is formed on the developing roller 3. The above-mentioned electrostatic latent image is developed by the toner layer and visualized as a toner image.

On the other hand, a recording material 104 which is a recording medium contained in a cassette 103 is supplied by a paper feeding roller 105 simultaneously with the formation of the latent image on the photosensitive drum 1. This recording material 104 is conveyed to roller-shaped transfer means 107 through conveying means in synchronism with the leading end of the toner image on the photosensitive drum 1, and the toner image is transferred to the recording material 104 by the transfer means 107. The recording material 104 to which the toner image has been transferred is conveyed to a fixating device 109, where the toner image is fixated as a permanent image. Any toner residual on the photosensitive drum 1 is removed by cleaning means 5. In the case of the present embodiment, mounting means 112 for removably mounting a process cartridge 100 are provided at two locations in the apparatus body.

Figure 2:
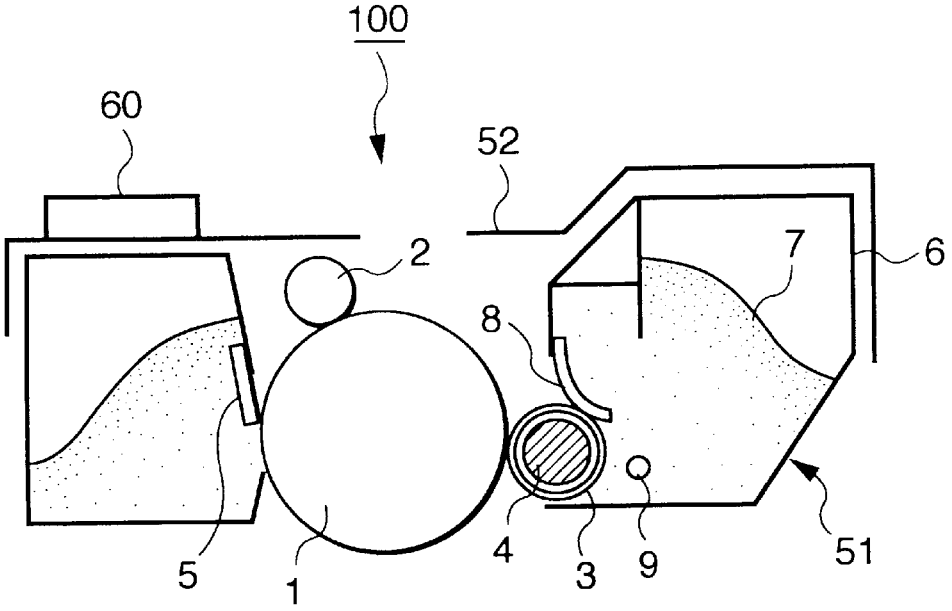
FIG. 2 shows the construction of a process cartridge according to Embodiment 1.

The cartridge 100 shown in FIG. 2 is such that the photosensitive drum 1, the charging roller 2, the developing device 51, the cleaning means 5 comprising an elastic cleaning blade, and a cover 52 partially covering these are made into a unit so as to comprise at least two portions. The photosensitive drum 1, etc. are assembled in the cartridge 100 in a predetermined mutual arrangement relation, and the process cartridge 100 can be inserted into and drawn out of a predetermined portion (mounting means 112) in the image forming apparatus body in a predetermined manner.

The developing device 51 is provided with a developing blade for regulating the thickness of the toner layer on the developing roller 3, and a detecting member 9 for detecting the residual amount of the toner in the developer container 6, and a magnet 4 is fixed in the developing roller 3.

Figure 3:
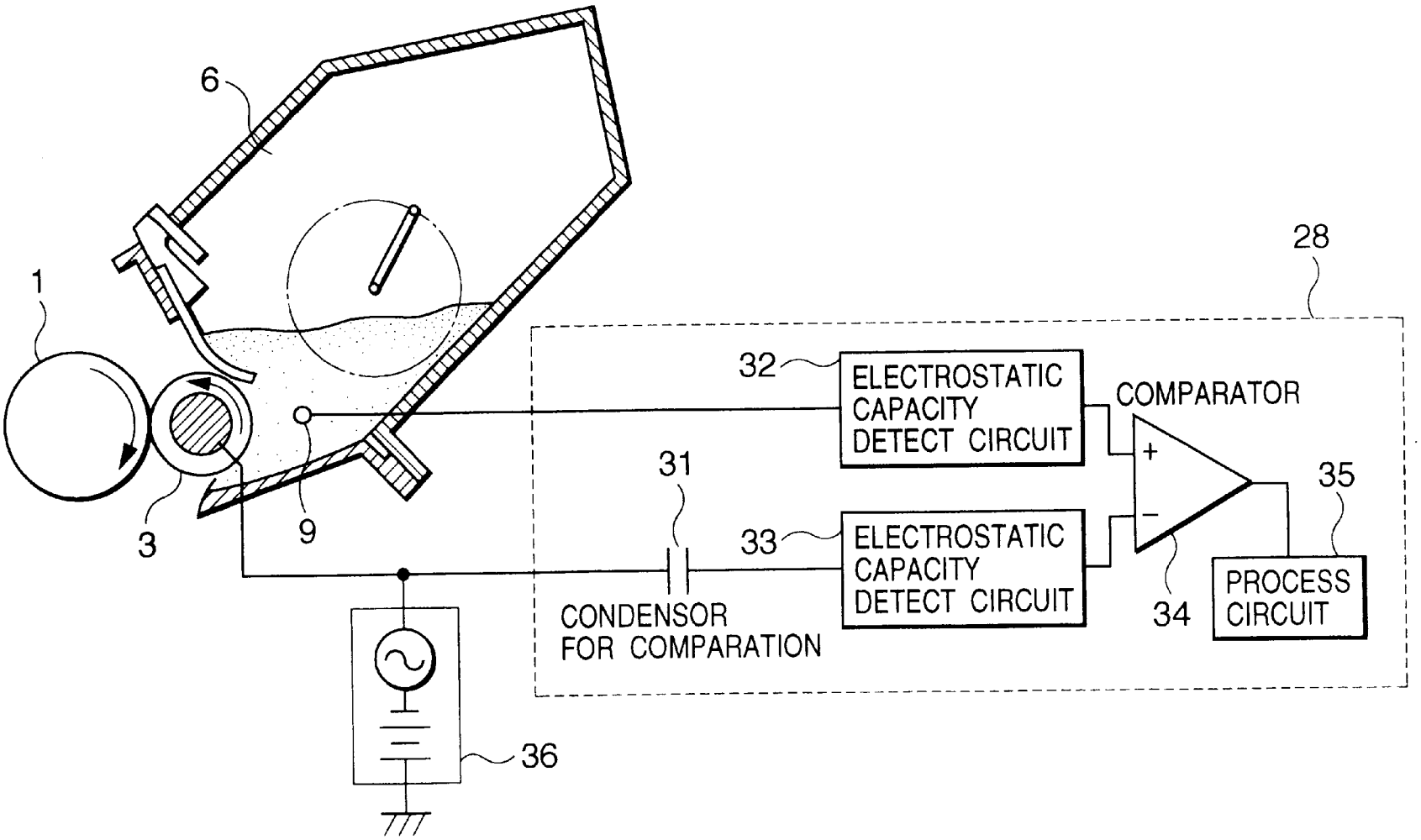
FIG. 3 is a circuit diagram showing a toner residual amount detection circuit.

FIG. 3 shows an example of a toner residual amount detecting mechanism used in the present embodiment. In this embodiment, the toner residual amount detecting member is an antenna-like electrode 9 horizontally extended in the developer container 6, and an AC voltage is applied from a power source 36 to between the electrode 9 and the developing roller 3. Toner residual amount detecting means, i.e., a toner residual amount detecting circuit 28, is provided in the apparatus body, and the electrostatic capacity between the electrode 9 and developing roller 3 found by the electrostatic capacity detect circuit 32 of the detecting circuit 28 and the electrostatic capacity of a condenser 31 for comparison found by the electrostatic capacity detect circuit 33 of the detecting circuit 28 are compared with each other by a comparator 34. When the difference between the two electrostatic capacities compared with each other by the comparator 34 has become minus, it is judged that the toner residual amount has become a predetermined value or less, and predetermined processing is carried out in a process circuit 35. Accordingly, by adjusting the capacity of the condenser 31 for comparison, the toner residual amount to be detected can be set arbitrarily.

The characteristic portion of the present invention is to provide non-volatile memory means 60 in the process cartridge 100, cause the memory means 60 to memorize the electrostatic capacity between the developing roller 3 and the antenna 9 when no toner exists, and correct the value of the electrostatic capacity of the condenser 31 for comparison on the basis of the value thereof.

The non-volatile memory means used in the present embodiment is not especially restricted if it rewritably memorizes and holds signal information, and may be, for example, electrical memory means such as a RAM or a ROM capable of rewriting, or magnetic memory means such as a magnetic recording medium, a magnetic bubble memory or a magneto-optical memory. In the present embodiment, NV (non-volatile) RAM is used from the viewpoints of the ease of handling and cost.

The present embodiment will hereinafter be described in greater detail.

Figure 4:
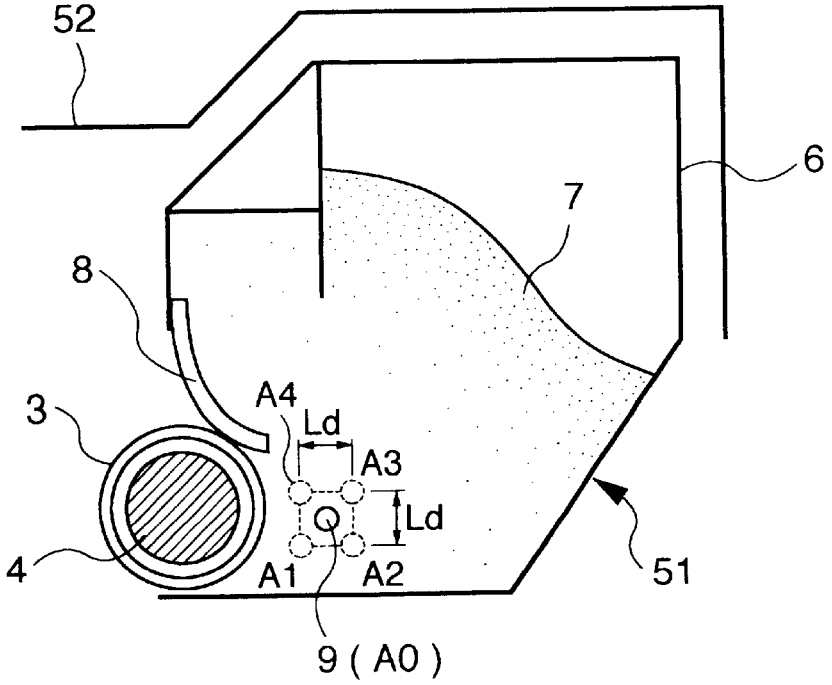
FIG. 4 is an enlarged view showing the developer container of the process cartridge of FIG. 2.
Figure 5:
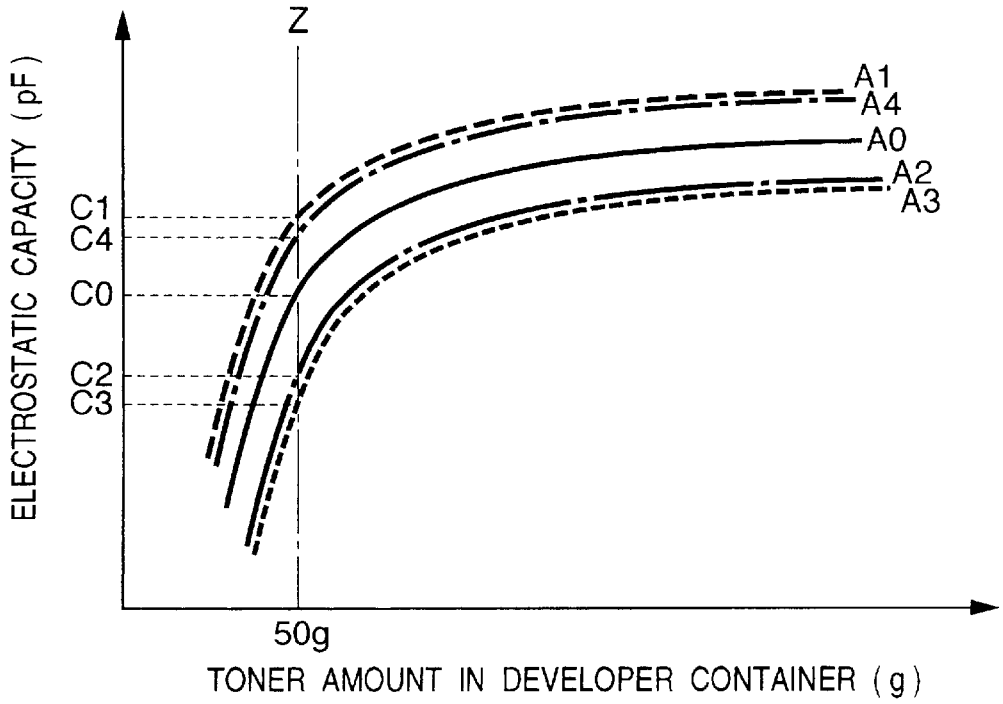
FIG. 5 is a graph showing a change in electrostatic capacity by the irregularity of the position of an antenna.

Let it be assumed that in the developer container 6 of such construction as shown in FIG. 4, the distance between the developing roller 3 and the antenna 9 is of the design value L=10 mm and has a tolerance $L_d$=±0.5 mm. The relation of the electrostatic capacity between the developing roller 3 and the antenna 9 in this case to the amount of residual toner in the developer container 6 at each of the points A0 to A4 between the developing roller 3 and the antenna 9 is shown in the graph of FIG. 5. If it is desired to effect the warning display of "Toner Low" by the detection of the amount of residual toner when the amount of residual toner is 50 g, the electrostatic capacity value on a line Z written in the graph of FIG. 5 can be used as a comparative condenser value. Let the electrostatic capacity values of the points A0 to A4 on a line X be defined as C0 to C4. For example, at A0, the electrostatic capacity is C0=10 pF.

Figure 6:
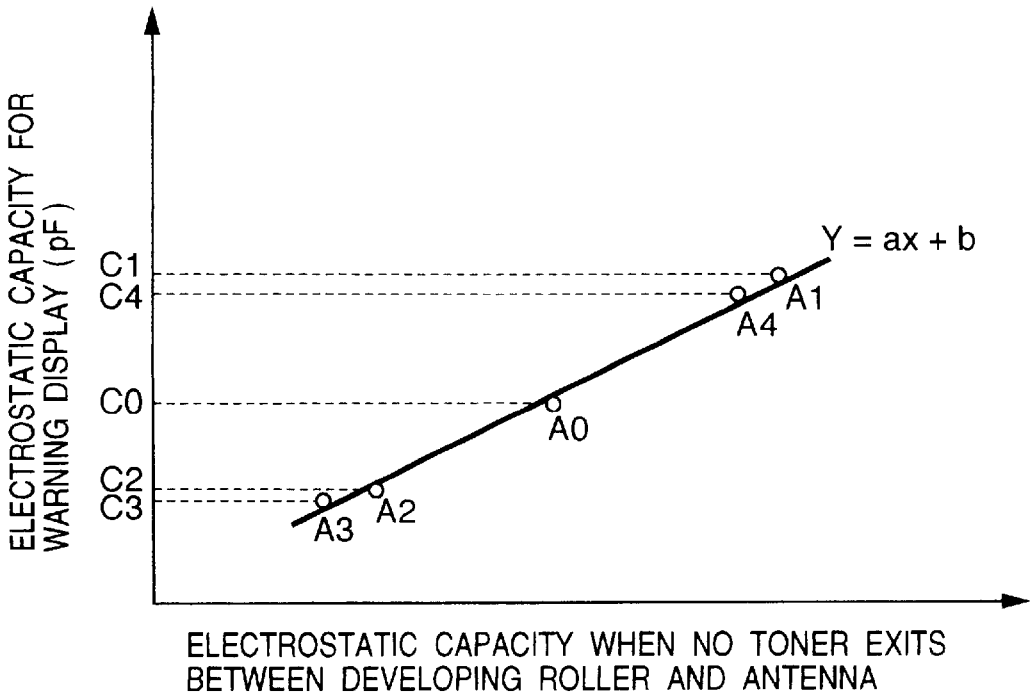
FIG. 6 is a graph showing the electrostatic capacity when warning is displayed when no toner exists.

The relation of electrostatic capacity values C0 to C4 of the respective points warning-displayed as "Toner Low" to the electrostatic capacities of the points A0 to A4 when the toner 7 is not at all present between the developing roller 3 and the antenna 9 is shown in the graph of FIG. 6. In the image forming apparatus studied in the present embodiment, the relation could be expressed by a substantially linear function as shown in FIG. 6. Thereby, it has been found that by measuring the electrostatic capacity when the toner 7 does not exist between the developing roller 3 and the antenna 9 during the manufacture of the cartridge, it is possible to correct the condenser for comparison.

Figure 7:
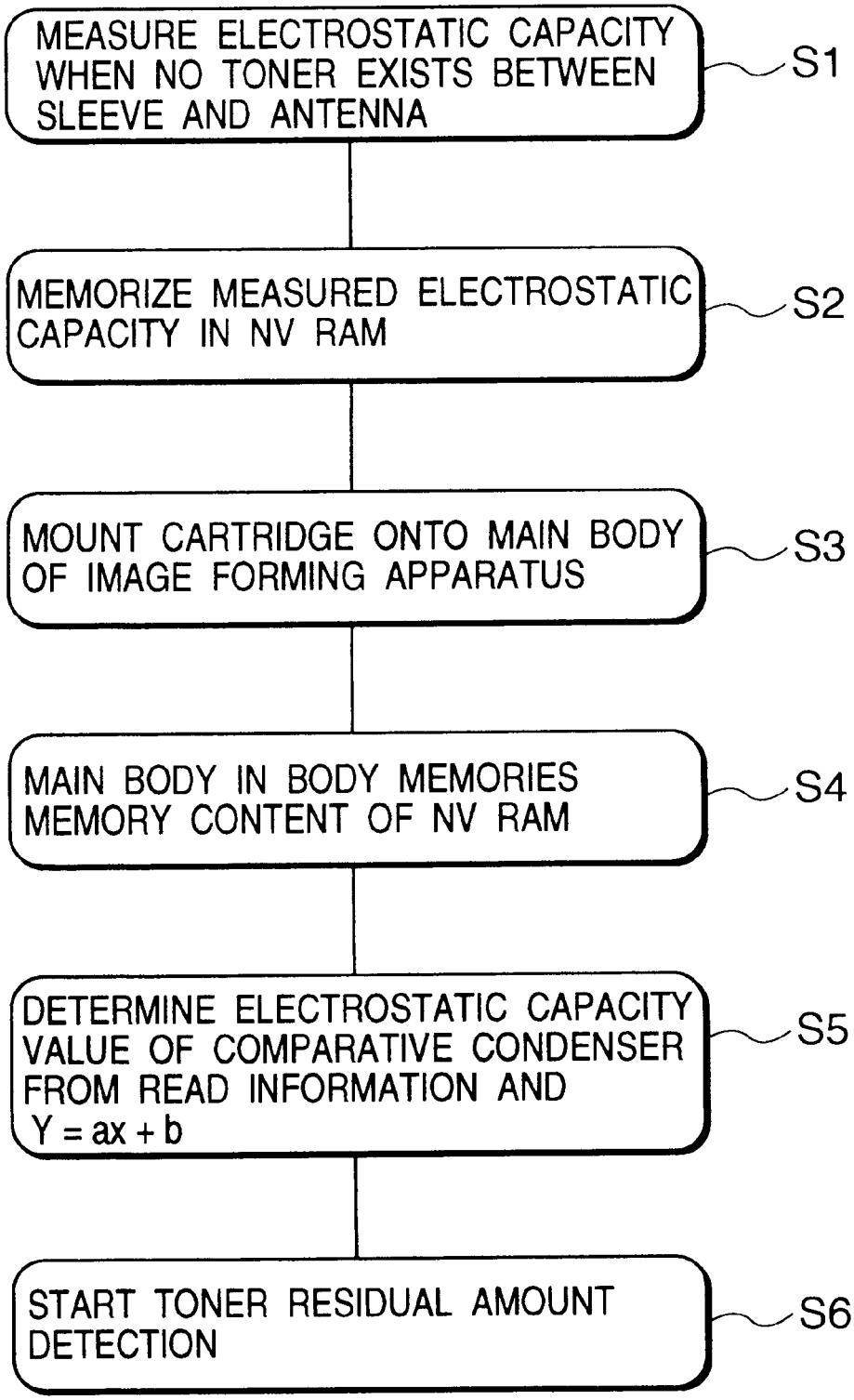
FIG. 7 a flow chart for executing the detection of the amount of residual toner in Embodiment 1.

The flow of correcting the electrostatic capacity value of the comparative condenser will now be described with reference to the flow chart of FIG. 7.

As previously described, during the manufacture of the cartridge, the electrostatic capacity when no toner exists between the developing roller 3 and the antenna 9 is measured (step 1), and the value thereof is memorized in NVRAM which is memory means provided in the cartridge 100 (step 2). When the cartridge 100 is mounted onto the main body of the image forming apparatus (step 3), a CPU in the main body of the image forming apparatus reads information stored in the NVRAM (step 4). The data (Y=ax+b) of FIG. 6 is already memorized in the main body of the image forming apparatus, and the electrostatic capacity value memorized in the NVRAM is substituted for, whereby the correction value of the comparative condenser is determined (step 5). The electrostatic capacity of the cartridge 100 and the electrostatic capacity of the comparative condenser are then sequentially compared with each other, and the detection of the amount of residual toner is effected (step 6).

In the above-described construction, the accuracy of the detection of the amount of residual toner when the correction of the electrostatic capacity of the comparative condenser when 4% printing was done on paper of A4 size was effected and that when said correction was not effected were examined. The frequency of the measurement is five times each. When the number of sheets which were void is n relative to the number of sheets m which were warning-displayed, the electrostatic capacity value of the comparative condenser is set so that (n/m)×100 may be 80%. Seeing the result of the measurement, irregularity was +13 to −14% for the set value 80% when the electrostatic capacity value of the comparative condenser was not corrected, whereas the irregularity could be suppressed to +5% to −7% by effecting correction.

According to the present embodiment, the correction of the electrostatic capacity by the distance between the developing roller 3 and the antenna 9 in each individual cartridge 100 is effected, whereby it has become possible to effect more accurate detection of the amount of residual toner, and a user has become able to use the cartridge to such an extent that there is no waste of the toner. Further, the electrostatic capacity value by the distance between the developing roller 3 and the antenna 9 is memorized in the memory means of each individual cartridge 100 and the main body of the image forming apparatus automatically reads that value and therefore, even if the cartridge 100 is interchanged in the course of its use, the correction of the electrostatic capacity between the developing roller 3 and the antenna 9 of that cartridge 100 is effected. Therefore, the improper detection of the amount of residual toner which would otherwise occur due to the interchange of the cartridge 100 can be prevented.

Figure 8:
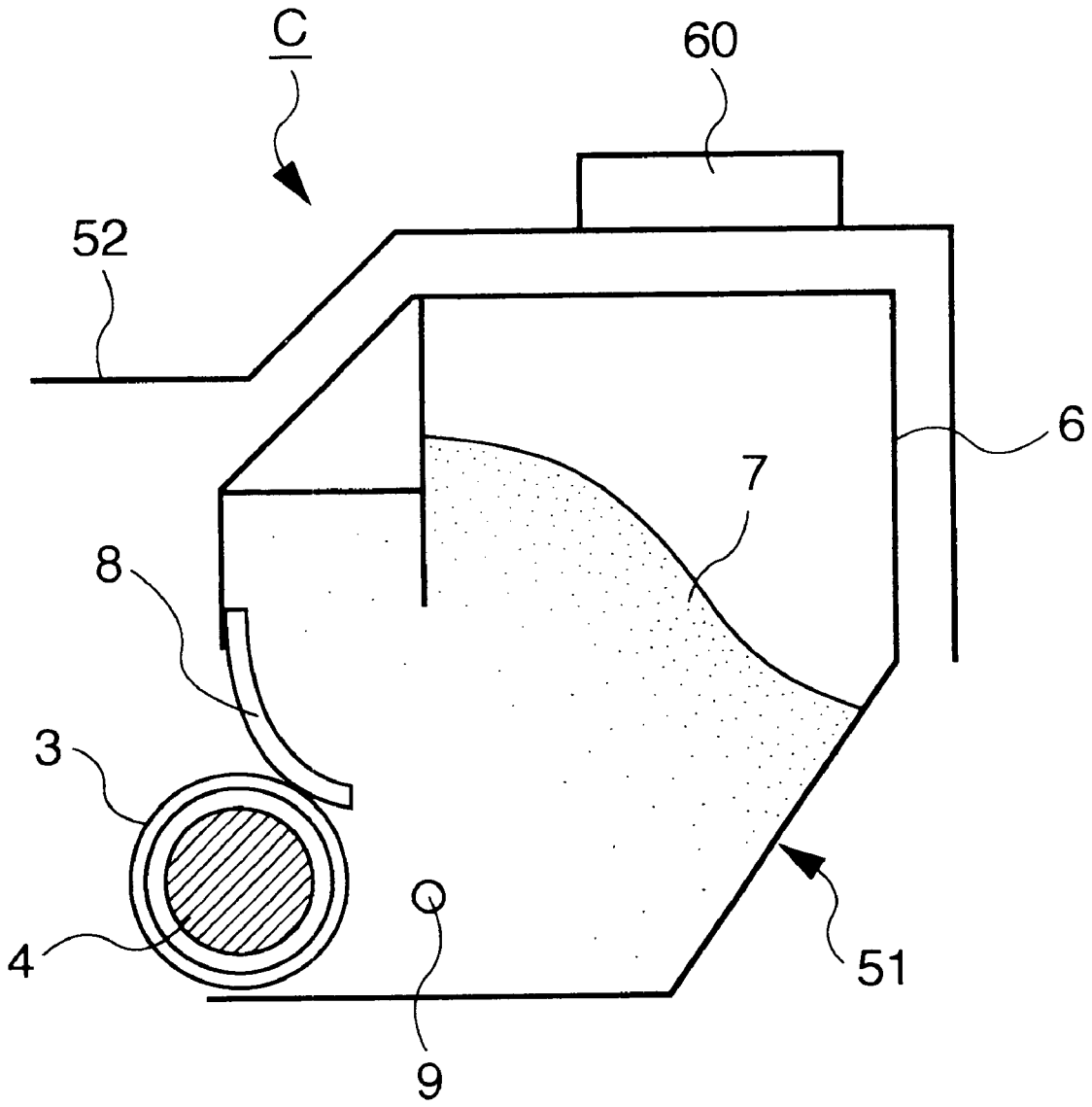
FIG. 8 shows the construction of a developing device in Embodiment 2.

FIG. 8 shows a developing device C made into a cartridge which is a second embodiment of the present invention.

The developing device C of the second embodiment is such that a developer carrying member 3 like a developing roller and developing means 51 having a developer containing portion 6 containing a toner 7 therein to supply a developer (toner) to the developer carrying member 3 are integrally made into a cartridge by a plastic frame member 52. That is, the developing device C of the present embodiment can be considered to be a cartridge made into a unit, excepting the electrophotographic photosensitive member 1 from the process cartridge 100 described in the first embodiment. Accordingly, the construction and action of the developer containing portion 6, memory means 60, etc. are similar to those in the first embodiment 1, and members similar in construction and action to those in the first embodiment are given similar reference numerals and the description thereof in the first embodiment is invoked.

A third embodiment of the present invention will now be described with reference to FIGS. 1, 2 and 8. This embodiment is one in which the present invention is applied to a case where use is made of toners for colors in a color printer or the like, in a process cartridge provided with a toner residual amount detecting mechanism and an image forming apparatus for effecting image formation with the process cartridge (hereinafter referred to as the cartridge) removably mounted thereon.

The colors of typical toners for colors include magenta, yellow and cyan. These toners, unlike the black toner when containing a magnetic material, does not contain any magnetic material. Therefore, the change in the electrostatic capacity between the developing roller and the antenna differs in the case of the toners for colors from the case of the black toner containing a magnetic material. Therefore, a plurality of comparative condensers must be provided in the main body of the image forming apparatus, and this leads to high costs. If conversely, only a single comparative condenser is provided in the main body of the apparatus, the accuracy of the detection of the amount of residual toner will become very irregular and accurate detection will become impossible because the dielectric constants of the toners for colors differ from one another.

Figure 9:
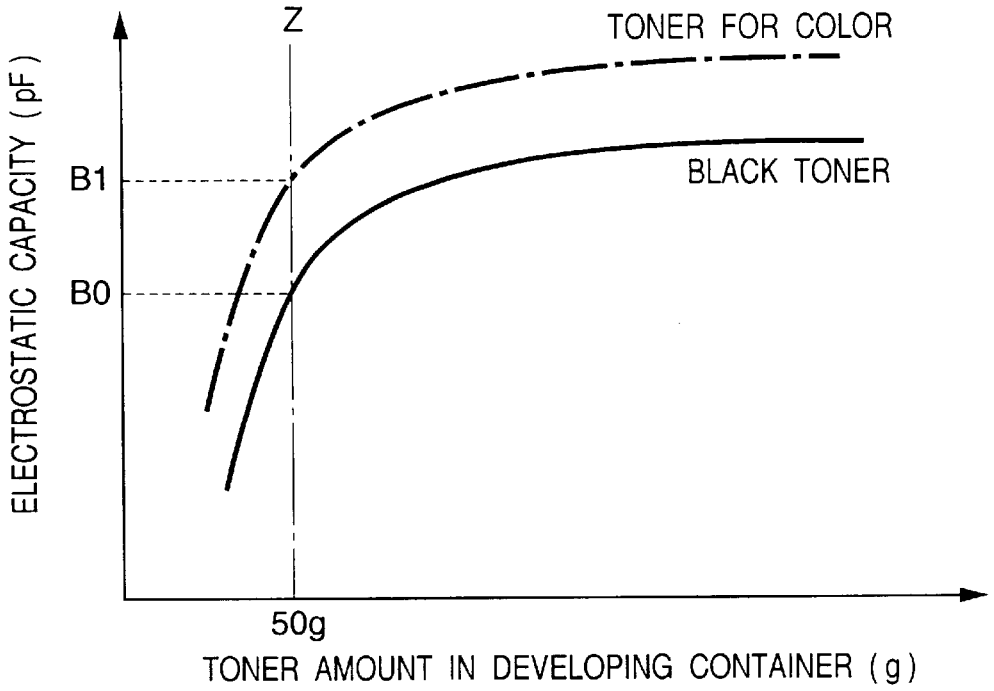
FIG. 9 is a graph showing changes in the electrostatic capacities of a black toner and a toner for color in Embodiment 3.

The third embodiment is characterized in that data capable of recognizing the toners for colors are memorized in memory means provided in the cartridge, and on the basis of this information, the electrostatic capacity value of the comparative condenser is corrected. Thus, in the cartridge, a single comparative condenser can be mounted for these toners differing in dielectric constant from one another. The present embodiment will now be described specifically. FIG. 9 is a graph showing the relation of the electrostatic capacity between the developing roller 3 and the antenna 9 to the amount of toner in the developer container in the case of the black toner containing a magnetic material (hereinafter referred to as the black toner) and the toner for color. It is to be understood that warning display is effected when the black toner is B0 and the toner for color is B1.

The Ref (reference) value of the electrostatic capacity of the comparative condenser in the main body of the image forming apparatus is B0 in the case of the black toner, and correction is effected so that the Ref value may become B1 when the cartridge 100 of the toner for color is used.

On the cartridge 100 side, when it is manufactured, a recognizing signal for discriminating between the black toner and the toner for color is memorized in NVRAM which is memory means. When for example, the cartridge 100 of the toner for color is mounted on the main body of the image forming apparatus, the CPU in the main body of the image forming apparatus reads the information memorized in the NVRAM. From this information, it is recognized that the mounted cartridge 100 contains the toner for color therein, and the main body of the image forming apparatus corrects the electrostatic capacity value of the comparative condenser from B0 to B1. The electrostatic capacity of the cartridge and the electrostatic capacity of the comparative condenser are then sequentially compared with each other.

Thus, even if use is made of a cartridge 100 containing therein the toner for color differing in dielectric constant, it is possible to cause the toner residual amount detecting mechanism to work properly on that cartridge 100. Also, information regarding the black toner or the toner for color is memorized in the memory means of the cartridge 100 and therefore, even if the cartridge 100 is interchanged in the course of its use, there will be no hindrance and the user need not perform the correcting operation by himself.

When the toner for color as described above issued, a proper value for each color for correcting the electrostatic capacity of the comparative condenser is memorized in the memory means provided in the process cartridge, whereby it has become possible to effect toner residual amount detection optimum for each color.

Also, in the image forming apparatus for effecting image formation with the process cartridge removably mounted thereon, each individual cartridge possesses information for correcting the electrostatic capacity of the comparative condenser and therefore, only one comparative condenser suffices for the image forming apparatus, and comparative condensers corresponding to the number of the colors are not required and thus, it is possible to reduce the costs.

A fourth embodiment of the present invention will now be described with reference to FIGS. 10 to 13.

In the fourth embodiment, the distribution of the number of print dots in the longitudinal direction is calculated and detected from the information memorized in the memory means provided in the image forming apparatus or the process cartridge, and the warning on the amount of residual toner is forcibly given. There will be the effect of the present invention even if said memory means is provided in the main body of the image forming apparatus. But by the memory means being provided in the process cartridge, the effect of the present invention can be reliably obtained without the memorized content of the memory means being reset even if the process cartridge is interchanged in the course of its use.

Figure 10:
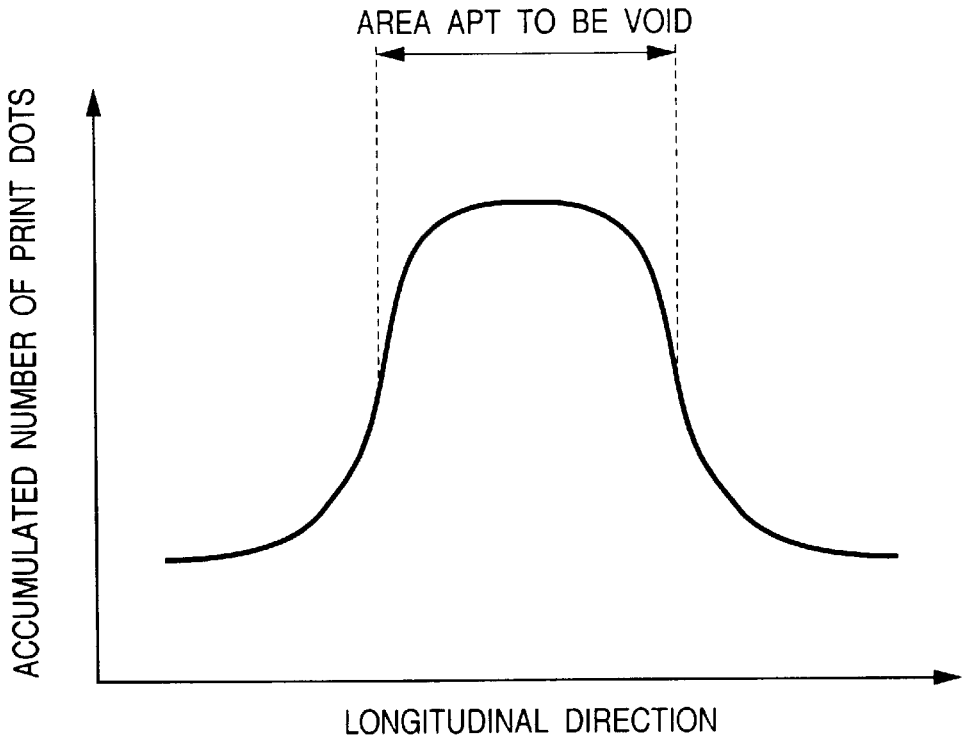
FIG. 10 is a distribution graph showing the accumulated number of print dots in the longitudinal direction when in Embodiment 4, printing is effected on small-sized paper.

When for example, printing is effected on only small-sized paper such as paper of A5 or B5 size, the distribution of the accumulated number of print dots in the longitudinal direction becomes such as shown in the graph of FIG. 10. That is, the accumulated number of print dots becomes great in the central portion in the longitudinal direction. If this state lasts, only the central portion in the longitudinal direction will become apt to be void early because the consumption of the toner is great in this portion. In the other portions, however, the toner exists sufficiently and therefore, it may happen that the total electrostatic capacity is not below the electrostatic capacity value of the comparative condenser for the detection of the amount of residual toner and warning display is not done.

In the fourth embodiment, the approximate amount of developed toner is calculated from the amount of the latent image and on the basis thereof, the distribution of the amount of toner in the developer container in the longitudinal direction is estimated, whereby the state of the amount of toner is judged. As a result, even if there is localized consumption of the toner which cannot be detected by the toner residual amount detecting means, it becomes possible to warn the user of it and display it.

Figure 11:
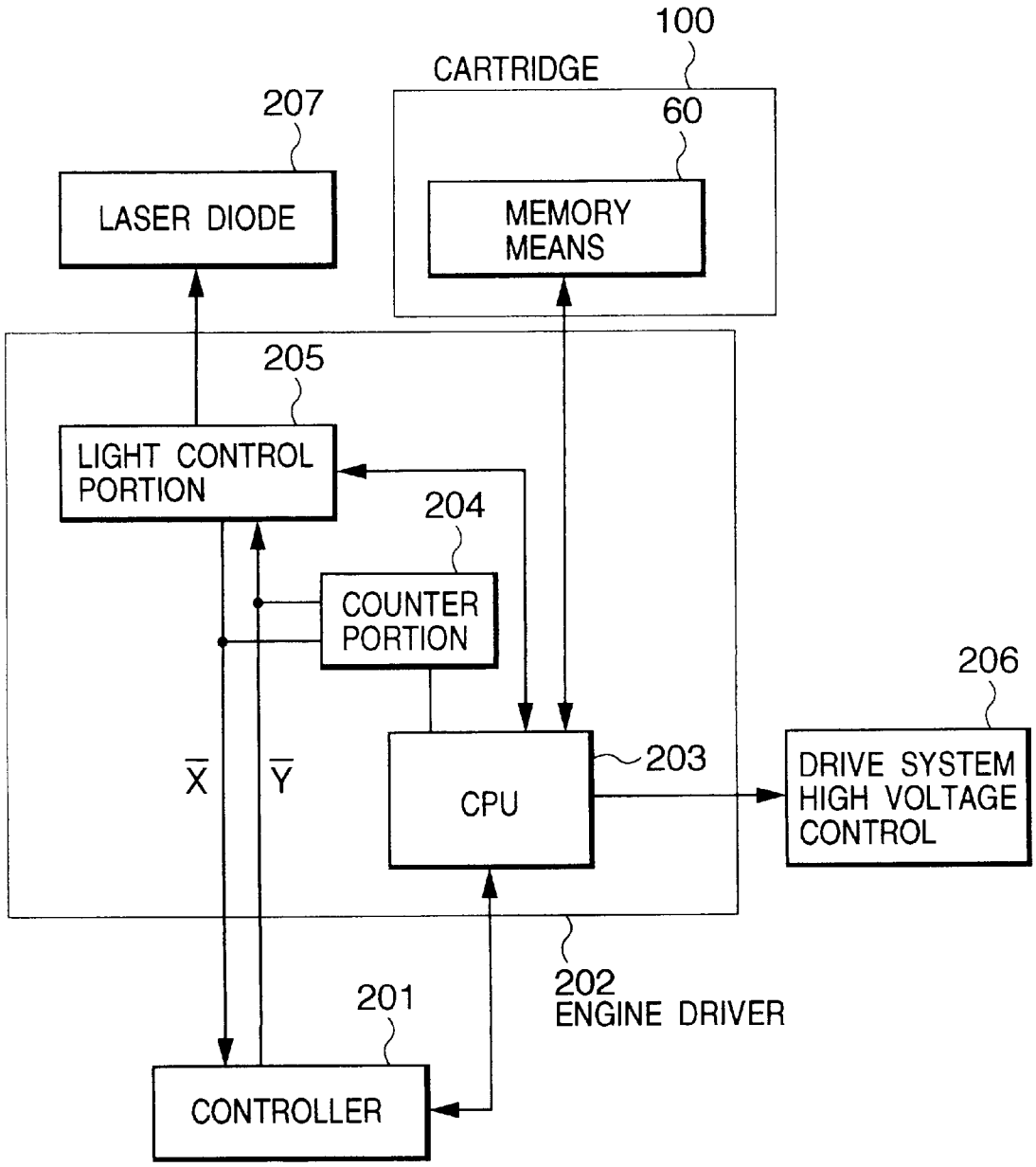
FIG. 11 is a block diagram showing a setup for finding the number of print dots in an image forming apparatus.

Description will now be made of a method of calculating the distribution of the number of print dots in the longitudinal direction. Referring to FIG. 11, a controller 201 has the function of converting print data transmitted from a host computer (not shown) into a printable signal. Also, an engine driver 202 has the function of controlling the paper supply and image formation sequence or detecting the state of the machine such as an error or the like.

The controller 201 is connected to a CPU 203 in the engine driver 202, and transmits an image signal and an image control signal to a light control portion 205. A control signal is transmitted from the CPU 203 to a drive motor for rotatively driving the photosensitive drum, etc. and to a charging and developing bias drive system high voltage control system 206.

The image signal and reference signal will further be described with reference to FIG. 12. The reference signal X is a signal outputted from the light control portion 205 during the writing-in of the image signal. The image signal Y is outputted from the controller 201 so as to be synchronized with this reference signal X. These are counted by a counter portion 204.

It is to be understood that on the image, a black pattern is the image signal Y and is 1 and a white pattern is 0. When the image signal is 1, a laser diode 207 is turned on in synchronism with the reference signal X. Consequently, the count value of the reference signal X while the image signal Y is 1 is equal to the number of dots of a light signal emitted from the laser diode 207.

Figure 12:
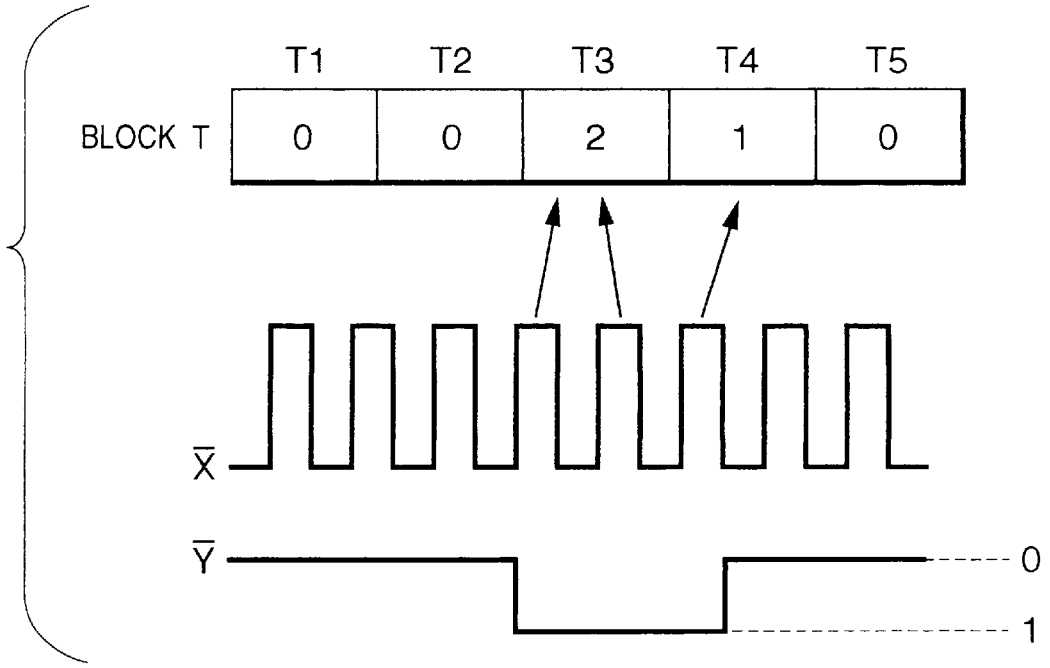
FIG. 12 is an illustration showing the relation between an image signal and a reference signal.

Next, as shown in FIG. 12, a block T is divided into a plurality of blocks at equal intervals in the main scanning direction. In FIG. 12, the division is a five-division comprising blocks T1 to T5. Counters are provided in the respective areas, and the count value of the reference signal X in the areas of those divided blocks is counted for each of the blocks T1 to T5. In FIG. 12, the count value is 2 for T3, is 1 for T4, and is 0 for the other blocks. The above-described process is repeated, and the distribution of the number of dots printed in the main scanning direction can be found from the count value added to the blocks. The distribution of the number of dots printed in the main scanning direction which has thus been found is memorized in the non-volatile memory means provided in the image forming apparatus or the process cartridge, and on the basis of the memorized information, the CPU corrects a reference value for detecting the amount of residual toner.

Figure 13:
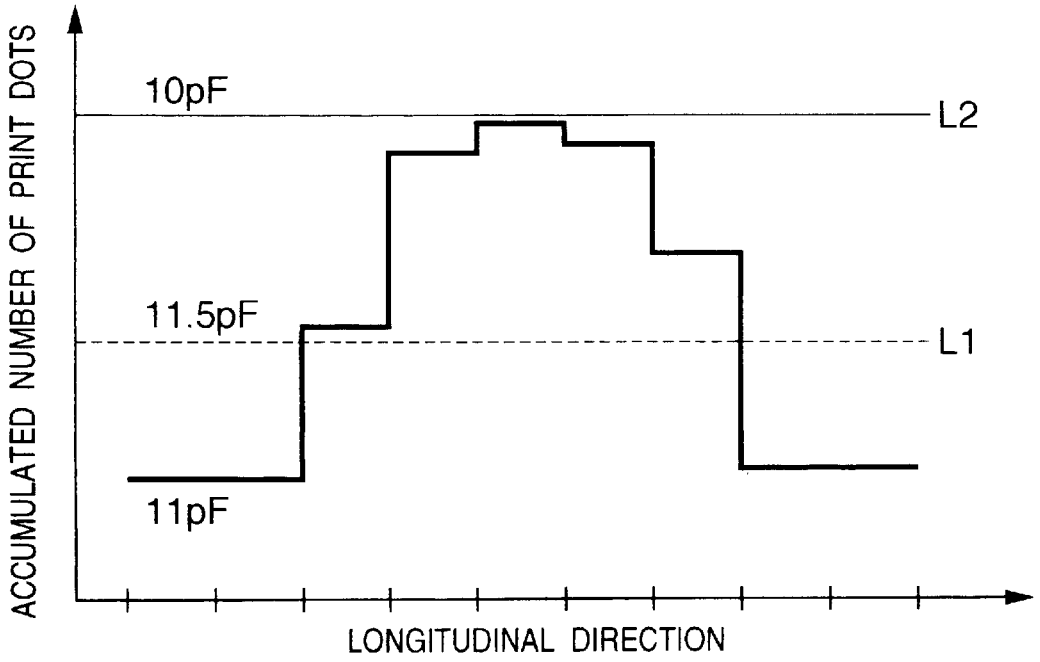
FIG. 13 is a distribution graph showing the accumulated number of print dots when small-sized paper is divided into nine blocks.

In the fourth embodiment, in an image forming apparatus of 600 dpi, the number of dots in a block divided into nine in the main scanning direction has been counted and memorized in NVRAM provided in the process cartridge. For example, the distribution of the accumulated number of print dots in the main scanning direction when in the process cartridge 100 used in the first embodiment and the main body of an image forming apparatus on which it is mountable, printing was effected in the longitudinal direction of A5 for the maximum printable width of A3 size has become such as shown in the graph of FIG. 13. In this graph, a broken line $L_1$ indicates the average of all the accumulated numbers of print dots in the main scanning direction, and a solid line $L_2$ indicates the accumulated number of print dots when the electrostatic capacity between the developing roller 3 and the antenna 9 has become equal to or less than the electrostatic capacity of the comparative condenser and warning has been given when the amount of toner in the longitudinal direction of the cartridge 100 has been consumed while being uniformized. That is, the maximum value of the distribution of the accumulated number of print dots intersects the broken line and when printing is effected for a while thereafter, the void by the deficiency of the toner on the image is created.

In the fourth embodiment, when any one of the blocks of the distribution of the accumulated number of print dots in the main scanning direction intersects the broken line $L_1$, the warning of "Toner Low" is given to the user irrespective of the result of the detection by the toner residual amount detecting means.

In the state of the distribution of the number of print dots in the main scanning direction as shown in FIG. 13, the electrostatic capacity between the developing roller 3 and the antenna 9 is 11 pF, and the electrostatic capacity when at this time, the toner in the developer container of the cartridge 100 was uniformized in the longitudinal direction (which corresponds to the broken line of FIG. 13) was 11.5 pF. The electrostatic capacity between the developing roller 3 and the antenna 9 during the time of the broken line $L_1$ (=the electrostatic capacity value of the comparative condenser) was 10 pF. When in this state, printing was continued on A5 size in its longitudinal direction, a void portion was created on the image, and when the electrostatic capacity between the developing roller 3 and the antenna 9 at that time was measured, it was 0.6 pF and it was confirmed that the stage for giving the warning by the toner residual amount detecting means was not yet reached.

However, as in the fourth embodiment, when any one of the blocks of the distribution of the accumulated number of print dots in the main scanning direction intersects the broken line, the warning of "Toner Low" or "Take out and shake the cartridge" is given to the user irrespective of the result of the detection by the toner residual amount detecting means. Whereby in the image forming apparatus of the present embodiment, the unsatisfactory image and the occurrence of the injury of the developing roller due to the deficiency of the toner can be prevented.

The electrostatic capacity A between the developing roller 3 and the antenna 9 during the warning is memorized in NVRAM. Next, when after the warning, the user takes out the cartridge 100 and shakes it to right and left to thereby uniformize the toner 7 in the developer container and again mounts the cartridge on the main body of the image forming apparatus. The user carries out printing if the difference ($|A1-B1|$) between the electrostatic capacity B between the developing roller 3 and the antenna 9 measured when the printing is effected and the electrostatic capacity A during the warning is equal to or greater than $\alpha$, the CPU in the image forming apparatus judges that the toner 7 in the cartridge 100 has been uniformized in the longitudinal direction, and the distribution of the accumulated number of print dots in the longitudinal direction hitherto memorized in NVRAM is also uniformized. From the uniformized state of the distribution, the number of print dots is again integrated, and the above-described steps are repeated.

In the fourth embodiment, $\alpha$ was set to 0.3 pF. This value is not within the measurement error of the electrostatic capacity for the toner residual amount detection and therefore, malfunctioning does not take place. The electrostatic capacity A during the warning was 11 pF and the electrostatic capacity B when the toner 7 was uniformized was 11.5 pF and therefore, the CPU in the image forming apparatus judges that the toner 7 in the cartridge 100 has been uniformized in the longitudinal direction, and the distribution of the accumulated number of print dots in the longitudinal direction hitherto memorized in NVRAM was also uniformized.

As described above, in the present embodiment, it has become possible to accurately effect the warning display of the amount of residual toner even in the one-sided consumption of the toner in the longitudinal direction of the process cartridge. To the user, the unsatisfactory image due to the deficiency of the toner does not occur and the toner in the cartridge can be used up without waste. Also, it is possible to prevent the occurrence of an injury attributable to the exhaustion of the toner on the developing roller due to void and the resultant direct contact of the developing roller with the developing blade.

A fifth embodiment of the present invention will now be described with reference to FIGS. 14A, 14B, 15, 16 and 17.

In the fifth embodiment, the accumulated number of print dots in the main scanning direction is calculated and detected from the information memorized in the electrophotographic image forming apparatus and the memory means provided in the process cartridge, and the detection level of the amount of residual toner is corrected. There is the effect of the present invention even if the memory means is provided in the image forming apparatus, but in the fifth embodiment, the memory means is provided in the process cartridge, whereby even if the process cartridge is interchanged in the course of its use, the effect of the present invention can be reliably obtained without the memorized content thereof being reset.

The method of calculating the accumulated number of print dots according to the present embodiment and the construction of the image forming apparatus are entirely the same as those in the fourth embodiment.

Figure 14A:
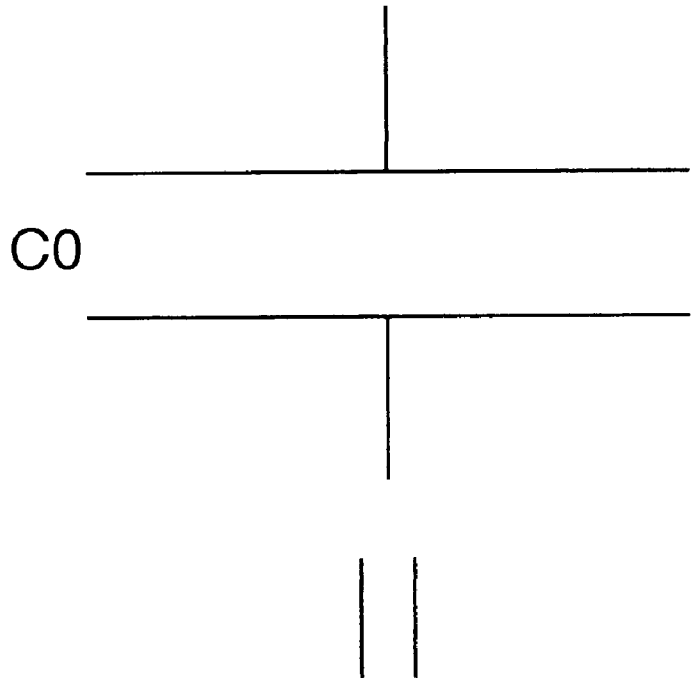
FIGS. 14A and 14B are illustrations showing a case where in Embodiment 5, a condenser is divided into n.
Figure 14B:
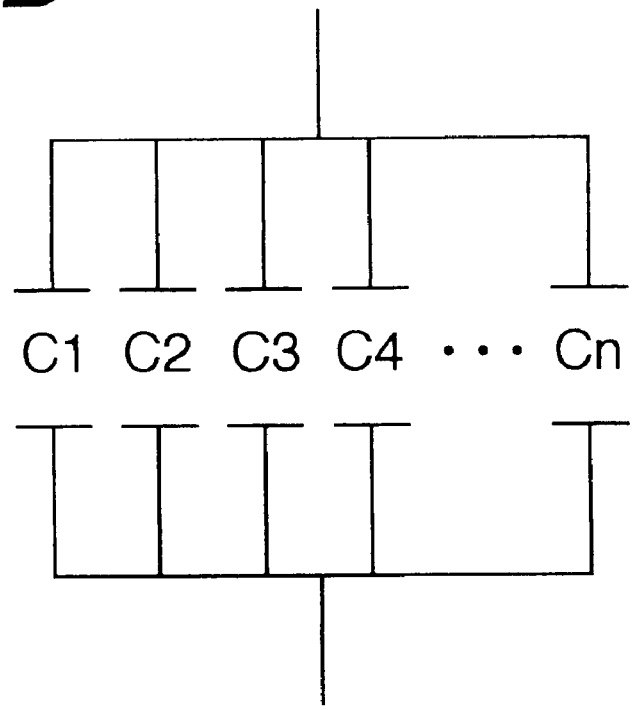
Figure 15:
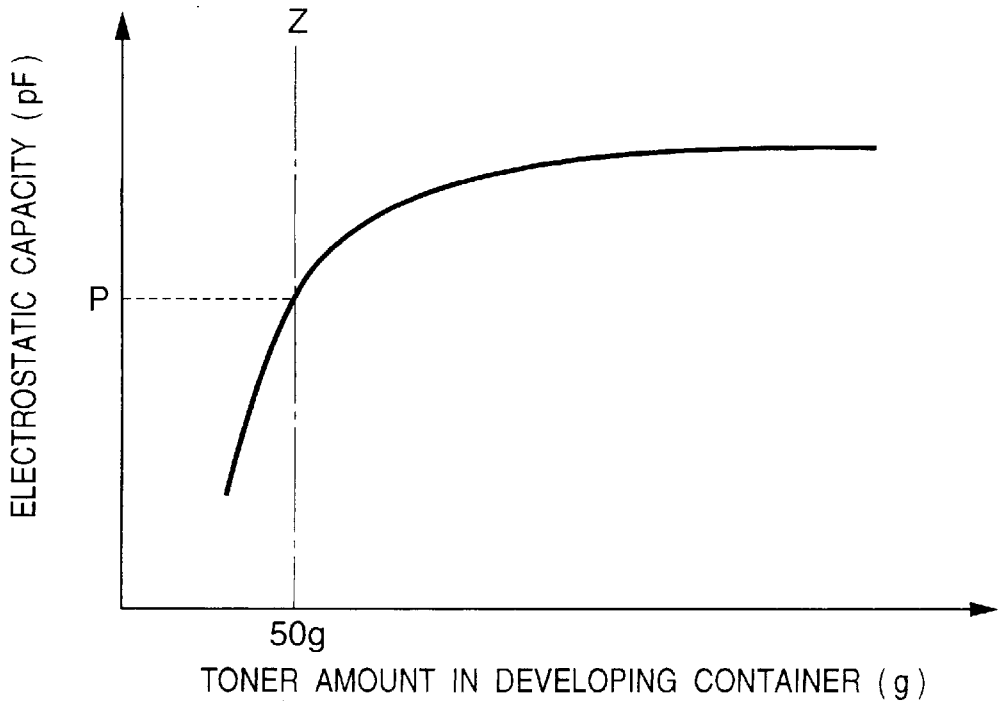
FIG. 15 is a graph showing the transition of the electrostatic capacity relative to the amount of toner in a developer container.

In the fifth embodiment, it is supposed that as described with respect to the fourth embodiment, the electrostatic capacity between the developing roller 3 and the antenna 9 in the developing device is also divided into the number into which the accumulated number of print dots was divided in the main scanning direction. FIGS. 14A and 14B show the equivalent circuits of the electrostatic capacity between the developing roller 3 and the antenna 9. When the electrostatic capacity C0 between the developing roller 3 and the antenna 9 shown in FIG. 14A is equidistantly divided into n, there are provided circuits C1 to Cn parallel-connected to one another as shown in FIG. 14B. Therefore, the sum of the divided individual electrostatic capacities is the electrostatic capacity C0. The result of the obtainment of the data of the electrostatic capacity for the amount of toner in the developer container is shown in the graph of FIG. 15. It is when as described in connection with FIG. 5, etc., the electrostatic capacity is P that warning display is effected in this graph.

Figure 16:
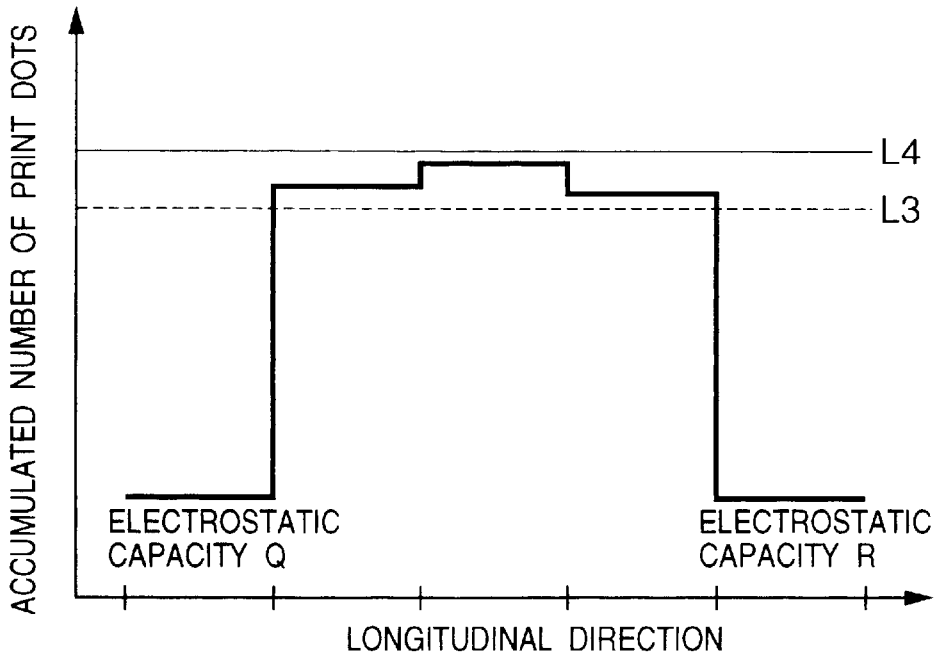
FIG. 16 is a distribution graph showing the accumulated number of print dots when small-sized paper is divided into five blocks.

In the graph of FIG. 16, the accumulated number of print dots for the main scanning direction at a certain number of prints and which is the standard for starting the correction of the detection level of the amount of residual toner is indicated by a broken line $L_3$, and it will be good if this accumulated number of print dots is smaller than the accumulated number of print dots indicated by a solid line $L_4$ when the electrostatic capacity between the developing roller 3 and the antenna 9 becomes equal to or less than that of the comparative condenser and warning is given when the amount of toner in the longitudinal direction of the cartridge 100 is consumed while being uniformized.

From the accumulated number of print dots of the other blocks than the block intersecting this broken line $L_3$, the amount of toner remaining in each block is estimated, and the electrostatic capacity of each block is found out from said data. For example, let it be assumed that the electrostatic capacity is divided into five and the accumulated number of print dots of three blocks intersects the solid line $L_4$ and the electrostatic capacities of the other two blocks are Q and R, respectively, from the accumulated number of print dots. Usually, warning display is carried out when the electrostatic capacity between the developing roller 3 and the antenna 9 has become P, and to eliminate the influence of the blocks which are not partially used, correction can be made by the electrostatic capacity of the comparative capacitor becoming the sum of P, (Q−P)/5 and (R−P)/5.

Figure 17:
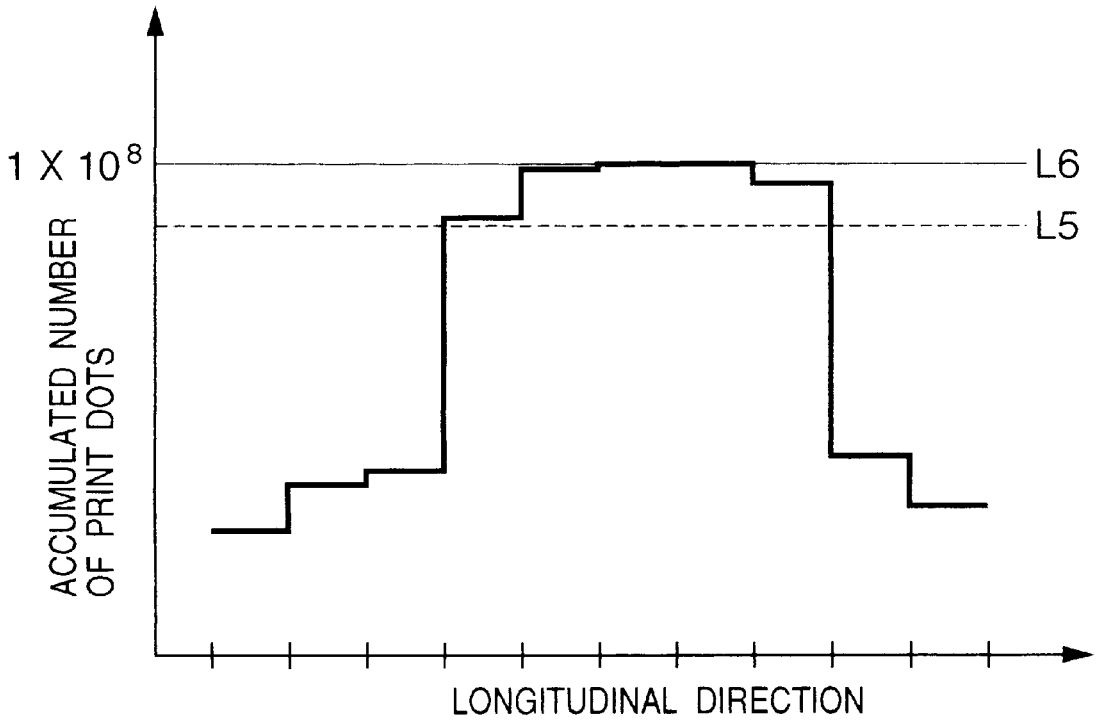
FIG. 17 is a distribution graph showing the accumulated number of print dots when small-sized paper is divided into ten blocks.

In the present embodiment, in an image forming apparatus of 600 dpi, an attempt was made to divide the accumulated number of print dots into ten in the main scanning direction and count it, and print in the longitudinal feeding of A5 for the maximum print paper supply width A3. In this case, correction was started when the accumulated number of print dots became $1\times10^8$. The electrostatic capacity of the comparative condenser of the toner residual amount detecting means was set to 10 pF. The graph of FIG. 17 shows the distribution of the accumulated number of print dots when warning display was effected, and five of ten blocks exceed a broken line $L_5$ which is a line for correcting the detection level of the residual amount, and three blocks of them intersect a solid line $L_6$ for effecting warning display. The electrostatic capacity between the developing roller 3 and the antenna 9 at this time was 10.8 pF, and the corrected electrostatic capacity of the comparative condenser was 10.9 pF, and it was confirmed that correction was effected substantially properly.

As described above, in the present embodiment, it has become possible to effect the detection of the amount of residual toner more accurately even for the one-sided consumption of the toner in the longitudinal direction. To the user, the unsatisfactory image due to the deficiency of the toner does not occur, and the occurrence of the injury of the developing roller attributable to the exhaustion of the toner on the developing roller due to the void and the resultant direct contact of the developing roller with the developing blade could be prevented.

The present invention is not restricted to the above-described embodiments, but covers modifications of the same technical idea.

What is claimed is:

1. An image forming apparatus having:

an image bearing member;

developing means for causing a developer to adhere to said image bearing member to thereby develop a latent image, said developing means having a developer carrying member carrying the developer thereon;

residual amount detecting means for detecting an amount of developer residual in said developing means, said residual amount detecting means measuring an electrostatic capacity between an electrode disposed near said developer carrying member and said developer carrying member;

comparing means for comparing the electrostatic capacity measured by said residual amount detecting means with a reference value, and judging whether the amount of residual developer is greater or smaller than a predetermined value;

memory means for memorizing an information for correcting the reference value; and correcting means for correcting the reference value in conformity with the correcting information.

2. An image forming apparatus according to claim 1, wherein said developing means and said memory means are made into a unit to be integrally interchangeable.

3. An image forming apparatus according to claim 1, wherein said image bearing member, said developing means and said memory means are made into and unit to be integrally interchangeable.

4. An image forming apparatus according to claim 1, wherein the correcting information is information based on the electrostatic capacity measured when the developer is not present between said developer carrying member and said electrode.

5. An image forming apparatus according to claim 1, further having informing means for calling upon a user for supplement of the developer in conformity with the result of the comparison by said comparing means.

6. An image forming apparatus according to claim 2, further having informing means for calling upon the user for the interchange of said unit in conformity with the result of the comparison by said comparing means.

7. An image forming apparatus according to claim 3, further having informing means for calling upon the user for the interchange of said unit in conformity with the result of the comparison by said comparing means.

8. An image forming apparatus according to claim 1, wherein said image bearing member is an electrophotographic photosensitive member.

9. A cartridge removably mounted on an image forming apparatus, said cartridge having:

developing means for supplying a developer to an image bearing member, said developing means having a developer carrying member and an electrode for detecting an amount of developer residual in said developing means; and memory means for memorizing an information for correcting a reference electrostatic capacity for judging whether the amount of residual developer is greater or smaller than a predetermined value.

10. A cartridge according to claim 9, further having an image bearing member to which the developer is supplied from said developing means.

11. A cartridge according to claim 9, wherein the correcting information is information based on the electrostatic capacity measured when the developer is not present between said developer carrying member and said electrode.

12. A cartridge according to claim 10, wherein said image bearing member is an electrophotographic photosensitive member.

* * * * *

UNITED STATES PATENT AND TRADEMARK OFFICE

CERTIFICATE OF CORRECTION

PATENT NO. : 5,946,522

DATED : August 31, 1999

INVENTOR(S) : Satoru INAMI

It is certified that error appears in the above-identified patent and that said Letters Patent is hereby corrected as shown below:

IN THE DRAWINGS:

Sheet 3, Figure 3, "COMPARATION" should read --COMPARISON--.
Sheet 6, Figure 6, "EXITS" should read --EXISTS--.
Sheet 5, Figure 7, in S2: "NV RAM" should read --NVRAM--.
Sheet 5, Figure 7, in S4: "MAIN BODY IN BODY MEMORIES MEMORY CONTENT OF NV RAM" should read --CPU IN MAIN BODY READS NVRAM--.

COLUMN 2:

Line 3, "Laid-Open Application" should read --Publication--.
Line 13, "Laid-" should be deleted.
Line 14, "Open Application" should read --Publication--.

UNITED STATES PATENT AND TRADEMARK OFFICE

CERTIFICATE OF CORRECTION

PATENT NO. : 5,946,522

DATED : August 31, 1999

INVENTOR(S) : Satoru INAMI

It is certified that error appears in the above-identified patent and that said Letters Patent is hereby corrected as shown below:

COLUMN 12:

Line 24, "and" should read --a--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*